US005194116A

United States Patent [19]

Davis et al.

[11] Patent Number: 5,194,116

[45] Date of Patent: Mar. 16, 1993

[54] ASSEMBLY WITH FLEXIBLE GLUE WHEEL FOR APPLICATION OF ADHESIVE OF BOOK BLOCK

[75] Inventors: Charles E. Davis, Crawfordsville; David A. Stephens, Waynetown, both of Ind.

[73] Assignee: R.R. Donnelley & Sons, Chicago, Ill.

[21] Appl. No.: 817,854

[22] Filed: Jan. 6, 1992

[51] Int. Cl.[5] ..... B05C 1/08; B42C 9/00

[52] U.S. Cl. ..... 156/578; 118/227; 118/231; 156/908; 412/8; 412/37

[58] Field of Search ..... 29/130, 132; 156/908, 156/582, 528; 412/37, 8, 38, 39; 118/227, 231

[56] References Cited

U.S. PATENT DOCUMENTS

| | | | |
|---|---|---|---|
| 1,867,803 | 7/1932 | Bredenberg | 156/908 |
| 1,879,757 | 9/1932 | Kusch | 412/37 |
| 2,671,912 | 3/1954 | Stein et al. | 412/37 |
| 3,594,837 | 7/1971 | French | 412/37 |
| 3,669,707 | 6/1972 | Donnelly et al. | 427/194 |
| 3,795,033 | 3/1974 | Donnelly et al. | 29/132 |
| 3,956,057 | 5/1976 | Jung | 412/37 |
| 3,976,814 | 8/1976 | Murphy | 29/132 |
| 3,980,514 | 9/1976 | Rosette et al. | 156/908 |
| 4,360,566 | 11/1982 | Shimieu et al. | 29/132 |
| 4,416,722 | 11/1983 | Bergman et al. | 156/908 |
| 4,588,470 | 5/1986 | Abegglen | 156/908 |

*Primary Examiner*—Willard Hoag
*Attorney, Agent, or Firm*—Arnold, White & Durkee

[57] ABSTRACT

An assembly for applying hot melt adhesive to the backbone of a book block to attach a cover includes a bath of hot melt glue heated to approximately 350° F. A metal wheel is submerged in the bath. The metal wheel is rotated and scrapers meter the hot melt adhesive on the surface of the metal wheel. The metal wheel transfers the hot melt adhesive to flexible adhesive distribution wheel. The flexible wheel is fabricated of a silicone rubber with iron oxide capable of withstanding the elevated temperatures of the hot melt adhesive while maintaining its flexibility. In addition, the cut and mold of the wheel results in greater flexibility of the wheel, allowing the wheel to flex to engage completely the backbone of each book block to apply the adhesive fully and completely.

19 Claims, 3 Drawing Sheets

ASSEMBLY WITH FLEXIBLE GLUE WHEEL FOR APPLICATION OF ADHESIVE OF BOOK BLOCK

BACKGROUND OF THE INVENTION

A. Field of the Invention

The present invention relates to a new and improved assembly for applying hot melt glue to book blocks, and specifically, to a new and improved assembly including a flexible wheel fabricated of a material capable of withstanding the high temperature of hot melt glue without deteriorating and of remaining flexible for applying the hot melt adhesive to book blocks.

B. Description of the Background Art

The assembly of a book with endsheets or end leaves attached to a hard or flexible cover requires several distinct operations. The body of the book must first be collated to provide for proper pagination of the text. The integrity of the assembled endsheets or signatures is then accomplished utilizing existing technology such as adhesive binding, "Smyth" sewing, side wire stitching or saddle stitching. The bound book block is then trimmed on three sides to provide the final size.

The book block backbone is then reconfigured to a specific configuration such as a flatback without joints, a flatback with joints, a round configuration only, or a round configuration with joints. To retain the selected shape placed into the backbone of the book, an adhesive, typically animal glue or hot melt in a film is applied, followed by the application of a reinforcing woven material. This is followed by a film of adhesive to which a liner with head bands is applied. The book is completed by joining the book block with a cover.

The current technology for metering and applying adhesive to the backbone of a book block can be accomplished by several different methodologies. One methodology involves facing the backbone of the book block downwardly while held in a clamp or a belt. In this position, the book block passes over a rigid wheel with a diameter cut to match the contour of the backbone of the book block. The wheel rotates in a bath of adhesive such as animal glue or hot melt and a scraper blade meters the adhesive on the wheel prior to frictional application of the adhesive from the rotating wheel onto the book block. The continuous rotating motion of the glue wheel is typically actuated by cams to cover the backbone from edge to edge without running over the head or tail of the backbone. The wheel size and radius are determined by the bulk of the book block. It can also, however, be affected by the flexibility of the book block. The contour of the backbone of the book block must match the glue wheel to achieve proper glue application since an improper fit can result in dry streaks that are a result of inadequate glue dispersion and thus, a weak overall binding.

Another methodology known in the art provides for the backbone of the book block to be facing upwardly while held between chains. A metal wheel is submerged in a bath of animal glue that is heated to approximately 150° F. As it rotates, the metal wheel transfers adhesive to a black butyl rubber wheel. The adhesive on the black butyl rubber wheel is then transferred to the backbone of each book as the backbones pass under and in engagement with the rubber wheel. This methodology has several shortcomings. It is restricted to animal glues, the black butyl rubber wheel material destructs at temperatures above 160° F., the wheel is stiff rubber that does not always conform to the shape of the backbone, and since animal glue is used, the bond provided by the glue is not as strong, flexible, durable or as compatible with other adhesives.

A third methodology is the extrusion of an adhesive which is usually hot melt glue by commercial equipment such as that provided by Nordson, Valco, Slautterback, or Spraymation. These systems allow for the use of hot melt adhesives but have several distinct disadvantages. For example, an extruded hot melt adhesive bond to the backbone is susceptible to delamination. Also, application inconsistencies can occur due to temperature and viscosity variances. Irregularity in beginning and ending of the application of the adhesive can cause the adhesive to run over the head and tail of the book. Stringing of adhesive on the trailing edge of the book can also occur when using this methodology.

It would be desirable to have an assembly available that could apply hot melt adhesive to the backbone of the book block without the disadvantages experienced by the existing methodologies.

SUMMARY OF THE INVENTION

Briefly, the present invention is directed to a new and improved assembly for applying hot melt adhesive to books, and specifically to the backbones of book blocks. The assembly includes a container of hot melt adhesive maintained at a temperature of approximately 350° F. A metal wheel is positioned within the container and rotates through the hot melt adhesive. Scrappers are mounted in the container to meter the hot melt adhesive on the periphery of the metal wheel. The metal wheel transfers the hot melt adhesive to a wheel of flexible virgin silicone rubber with iron oxide configured to maximize the flexibility of the wheel. Book blocks are sequentially moved beneath and in contact with the flexible wheel. As this occurs, hot melt adhesive is applied by the flexible wheel from the head to the tail of the book block. The precise application of the adhesive is controlled by a vertical motion control and a braking control.

BRIEF DESCRIPTION OF THE DRAWINGS

The above and other objects and advantages and novel features of the present invention will become apparent from the following detailed description of a preferred embodiment of the invention illustrated in the accompanying drawings wherein.

Figure 1:
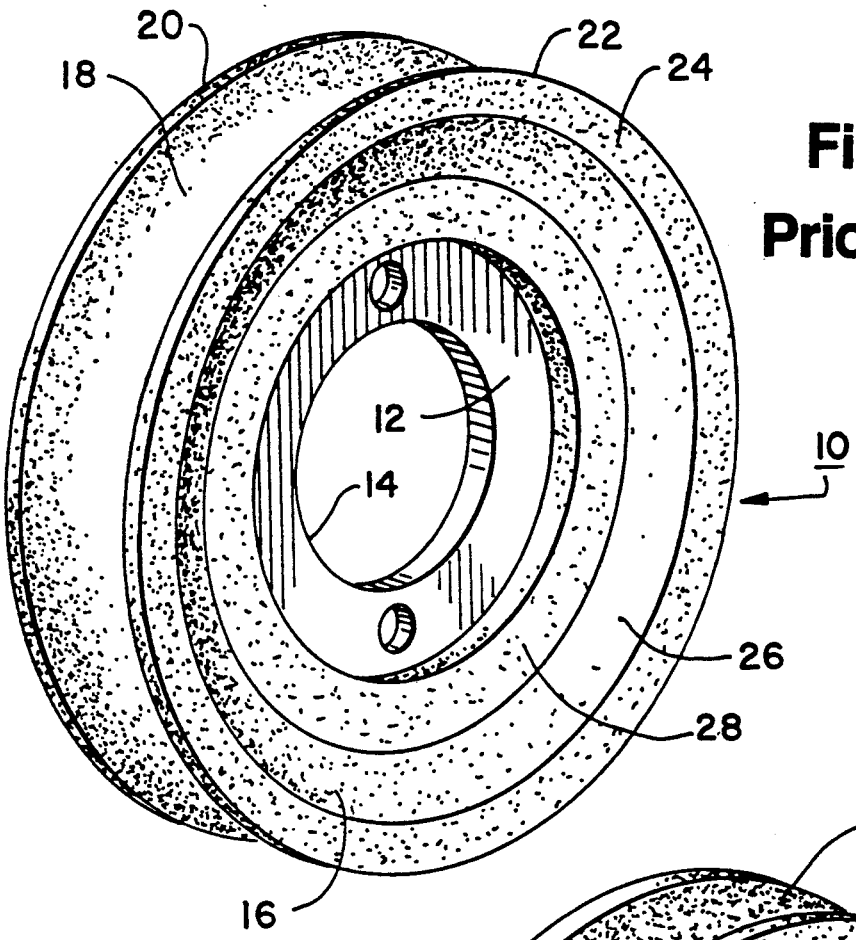
Fig. 1 Prior Art
FIG. 1 is a perspective view of a prior art butyl rubber glue wheel.
Figure 2:
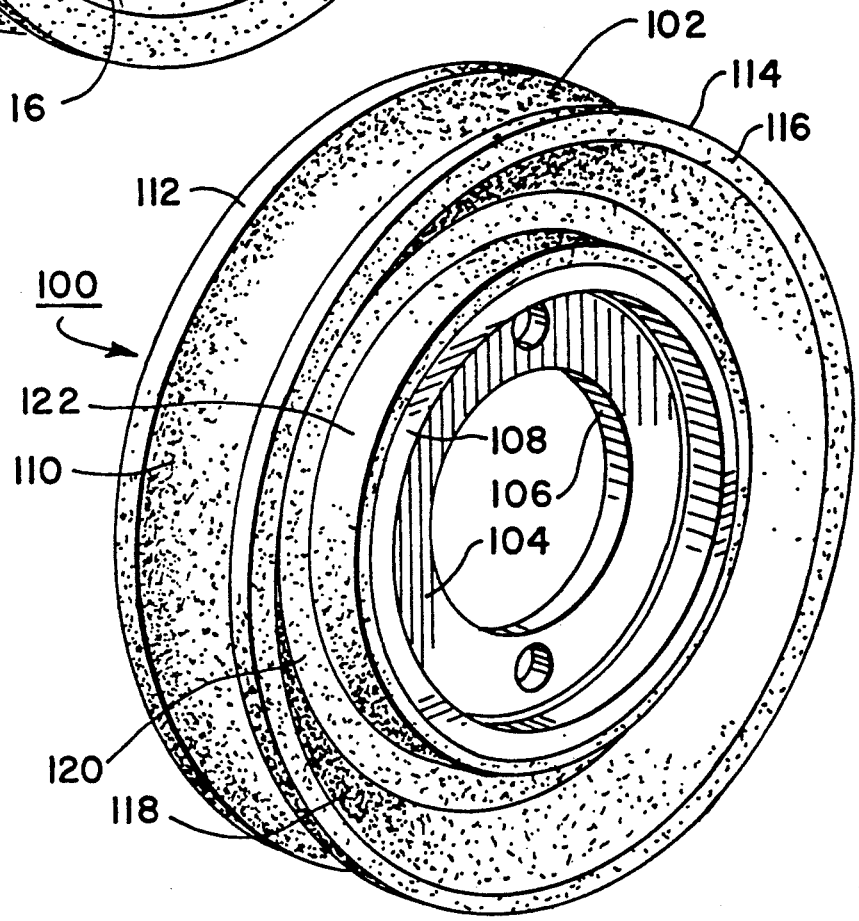
FIG. 2 is a perspective view of a flexible glue wheel constructed in accordance with the principles of the present invention.

While the invention is susceptible to various modifications and alternative forms, a specific embodiment thereof has been shown by way of example in the drawings and will be described in detail. It should be understood, however, that it is not intended to limit the invention to the particular form disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Referring initially to FIG. 1 there is illustrated a prior art black butyl rubber wheel generally designated by the reference numeral 10. The prior art wheel 10 is used for the application of animal glue or low temperature adhesive to the backbones of book blocks. The wheel 10 is formed on and around a flat metal washer 12. The flat metal washer 12 includes a central aperture 14 for mounting on a rotating axle. The washer 12 provides little to no support to a rubber body 16 of the wheel 10. Consequently, most of the support is provided by the material of the rubber body 16. This requires a rigid, less flexible butyl rubber. The black butyl rubber material of the wheel 16 cannot withstand temperatures above 175° F. since it will destruct. In addition, the rubber material is stiff and is not sufficiently flexible to conform to a variety of shapes and sizes of backbones.

The prior art rubber wheel 10 includes an outer circumferential U-shaped groove 18 into which the backbones of book blocks pass and are engaged. Typically, an animal glue coats the groove 18 and is transferred by frictional engagement to a backbone that comes in contact with the groove 18. There is a first rim 20 and a second rim 22 on opposite sides of the groove 18. Extending downwardly from the rims 20 and 22 toward the aperture 14 are parallel flat sides 24. A gradually inclined wall portion 26 extends from the parallel flat sides 24 toward the flat metal washer 12. The gradually inclined wall portions 26 terminate at flat wall portions 28 that extend parallel to the flat sides 24. The flat wall portions 28 are molded onto the flat metal washer 12 providing a bond and physical connection between the flat metal washer 12 and the black butyl rubber body 16.

Due to the material of the glue wheel 10, the glue wheel 10 cannot be used with high temperature adhesives such as hot melt glue that typically is at a temperature of 350° F. In addition, the material of the glue wheel 10 is relatively inflexible. As a result, adequate glue coverage is not always attainable using the glue wheel 10 when a variety of sizes and configurations of book block backbones are passed through an assembly including a glue wheel 10.

The deficiencies of the prior art are overcome by the flexible glue wheel of the present invention which is generally designated by the reference numeral 100 and illustrated in FIGS. 2–6. The flexible glue wheel 100 can be used to apply hot melt glue or adhesive to the backbone of book blocks. Prior to the development of the flexible glue wheel 100, hot melt adhesive was limited to application by extrusion machinery. These machines and the extrusion of hot melt glue have several short comings that are overcome through the use of the flexible glue wheel 100.

The flexible glue wheel 100 includes a flexible wheel 102 mounted on a rigid metal hub 104. The rigid hub 104 includes a central aperture 106 and a flange 108. The flexible wheel 102 is molded of virgin silicone rubber with iron oxide (ZZ-R-7650; class 2A; 45 durometer) that is capable of withstanding temperatures of 450° F. without deterioration or losing its flexiblity. This material provides two important functions. One function is the ability to withstand the high temperatures of hot melt glue or adhesive that is typically at a temperature of 350° F. The silicone rubber material of the flexible wheel 102 can withstand the temperatures of hot melt adhesive without deterioration while retaining its flexibility. A second important function of the material of the flexible wheel 102 is the flexibility of the material over the full range of temperatures to which the wheel 102 may be exposed. This flexibility is highly desirable since the flexible wheel 102 must flex to accommodate a wide variety of sizes and configurations of backbones of book blocks.

The flexiblity of the flexible glue wheel 102 is further enhanced by its cut and configuration. Specifically, glue wheel 102 includes a U-shaped groove 110 on the outer periphery thereof. The sides of the U-shaped groove 110 terminate in parallel rims 112 and 114. To accommodate different sizes and configurations of backbones, it is desirable that the rims 112 and 114 flex relative to each other. In addition to the material, the rims 112 and 114 are able to flex due to the configuration of the glue wheel 102. Each outer side of the glue wheel 102 is defined by a flat parallel surface 116 that extends downwardly from each rim 112 and 114 toward the central aperture 106. At the lower edges of the parallel flat sides 116 there is a sharp undercut 118 extending toward the interior of the flexible glue wheel 102. The sharp undercut 118 terminates in a flat side portion 120 that is parallel to the flat side 116. The flat side portions 102 extend inwardly towards the aperture 106 and terminate at flanges 122. The flanges 122 extend perpendicularly to the flat side portions 120 and extend along each flange 108 of the rigid hub 104. Each flange 122 is secured to the corresponding flange 108 to secure each flange 122 and the flexible glue wheel 102 to the hub 104.

The combination of the silicone rubber of the flexible glue wheel 102 and the sharp undercut 118 provide increased flexibility such that the rims 112 and 114 can flex outwardly and downwardly toward the central aperture 106 to accommodate a wide variety of shapes and configurations of book block backbones. The flanges 108 of the rigid hub 104 provide support to the flexible wheel 102 thus allowing a softer and more flexible material to be used in forming the flexible wheel 102. In contrast, the prior art glue wheel 10 is secured to a washer 12 which provides no support. Consequently, the material of the rubber body 16 is necessarily harder and more rigid and not sufficiently flexible to accommodate backbones of different sizes and configurations.

Figure 3:
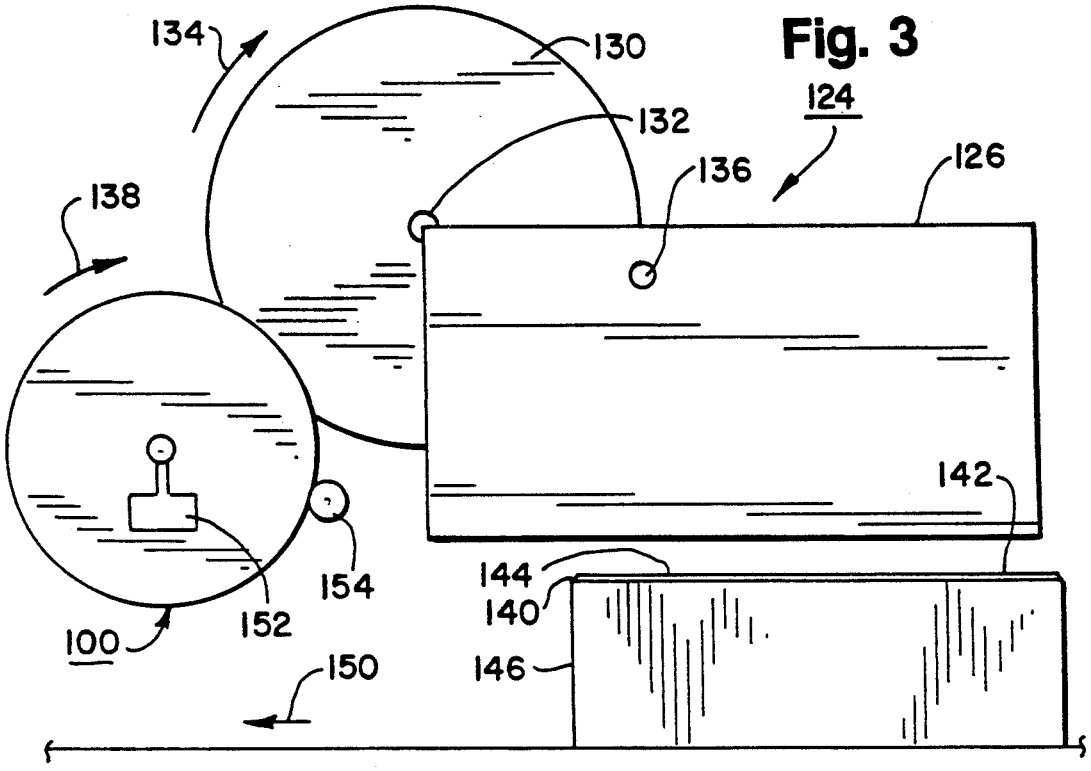
FIG. 3 is a diagrammatic illustration of an assembly for applying adhesive to book blocks in accordance with the principles of the present invention and prior to the application of glue to the backbone of a book block.
Figure 4:
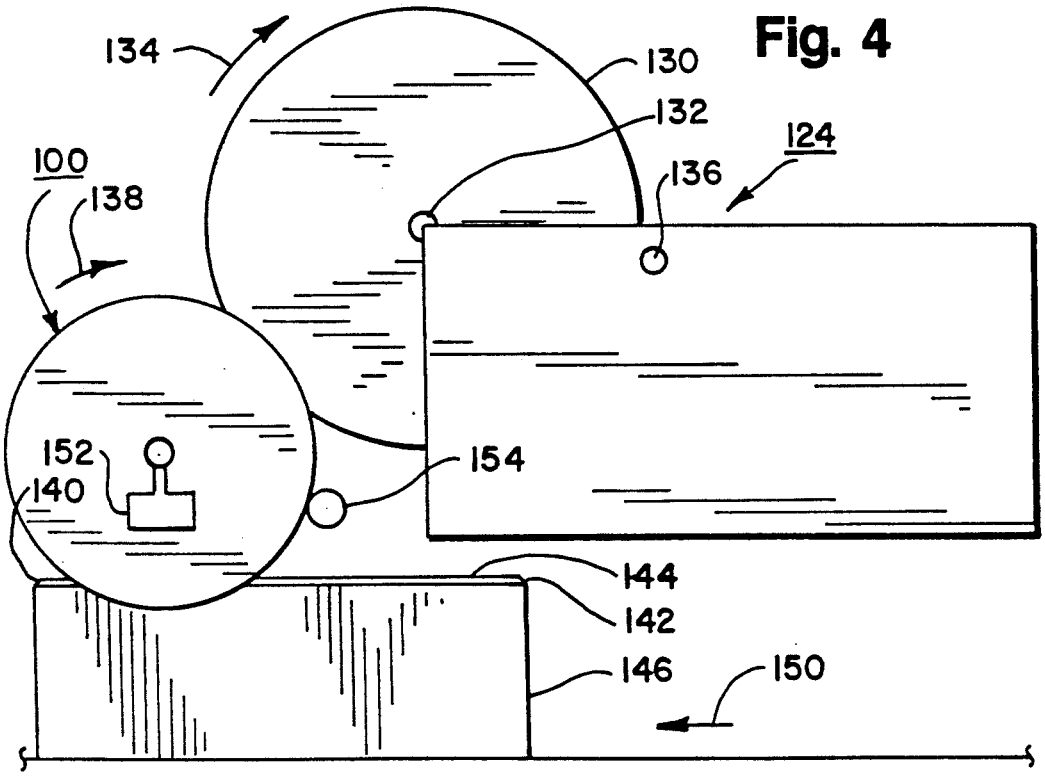
FIG. 4 is a view similar to FIG. 3 with the book block advanced to a position at which the flexible glue wheel engages the backbone of the book block.
Figure 5:
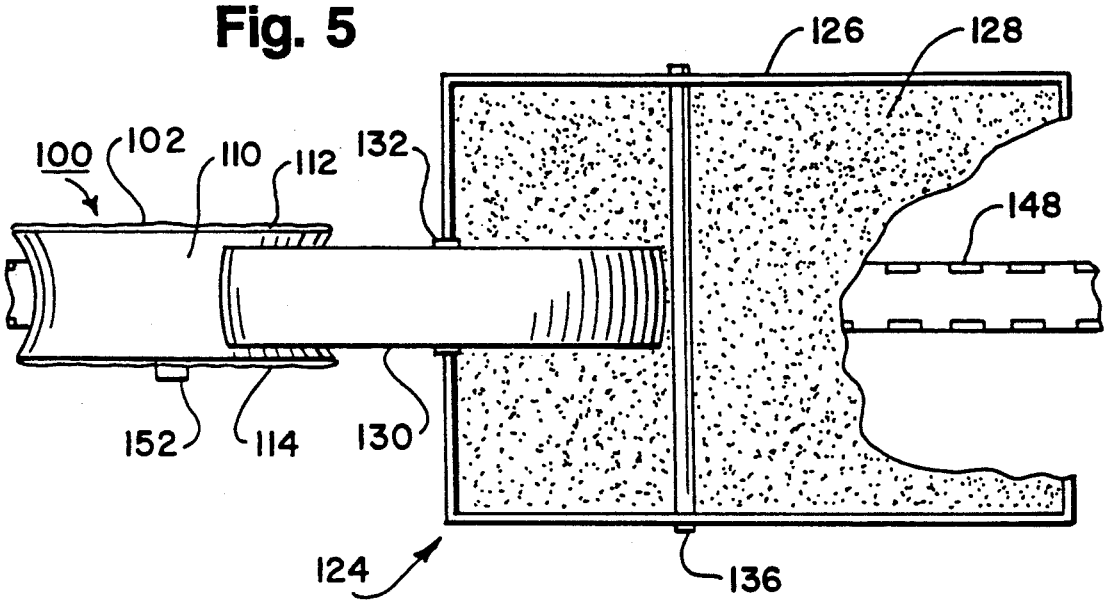
FIG. 5 is a top partially cut away view of the assembly for applying adhesive to book blocks.

Turning now to FIGS. 3–5, the flexible glue wheel 100 as used in an adhesive application assembly is illustrated. The assembly generally designated by the reference numeral 124 includes a container 126 of hot melt adhesive 128 which is maintained at a temperature of approximately 350° F. A rigid metal adhesive transfer wheel 130 is mounted on an axle 132 and partially extends into the hot melt adhesive container 126. The rigid metal adhesive transfer wheel 130 is rotated clockwise in the direction of the arrow 134, and a scraper 136 meters hot melt adhesive onto the outer periphery of the rigid metal adhesive transfer wheel 130.

The hot melt adhesive on the peripheral surface of the rigid metal adhesive transfer wheel 130 is transferred to the flexible glue wheel 100 by frictional engagement with the U-shape groove 110 in the flexible glue wheel 100. This occurs while the flexible glue wheel 100 rotates in the direction of the arrow 138 which is also in the clock-wise direction. This engagement of the outer peripheral surface of the rigid metal adhesive transfer wheel 130 and the U-shaped groove 110 is best illustrated in FIG. 5.

The flexible glue wheel 100 applies the hot melt glue from the head 140 to the tail 142 of a backbone 144 of a book block 146. By comparing FIGS. 3 and 4 it can be seen how the application of hot melt adhesive by the flexible glue wheel 100 onto a backbone 144 is accomplished. The book block 146 with the backbone 144 upward is carried by carrier chains 148 (FIG. 5) in the direction of the arrow 150 to engage and move under the flexible glue wheel 100. The application of hot melt glue from the head 140 to the tail 142 of the backbone 144 is controlled by a vertical up and down motion control 152. Control of the application of the adhesive from the head 140 to the tail 142 of the backbone 144 is further enhanced by a braking control 154 that controls the revolution of the flexible glue wheel 100.

Figure 6:
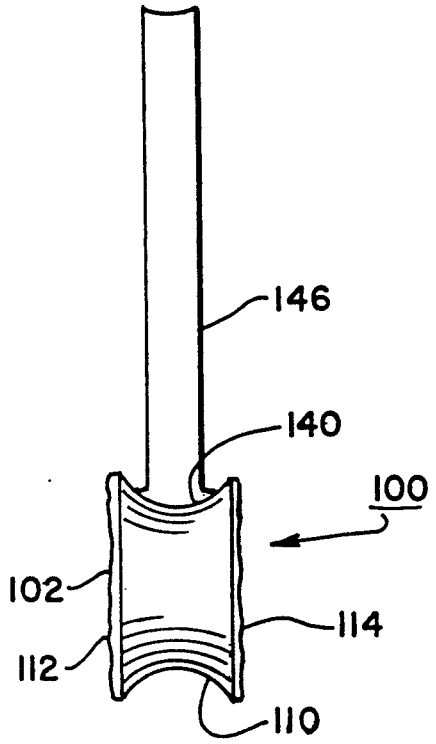
FIG. 6 is a diagrammatic illustration of the engagement of the flexible glue wheel of the present invention with a backbone of a book block.

The engagement of the backbone 144 of a book block 146 with the U-shaped groove 110 of the flexible glue wheel 100 is best illustrated in FIG. 6. As illustrated, the flexibility of the glue wheel 100 is such that the U-shaped groove 110 comes in total and complete contact with the backbone 144 thus ensuring complete coverage of the hot melt adhesive on the backbone 144. The advantage of the assembly 124 as described above is that hot melt adhesive at the elevated temperature of 350° F. may be applied from a flexible glue wheel 100 located above the book blocks 146 to which the adhesive is applied. In addition, there is complete, even and accurate distribution of hot melt glue from the head 140 to the tail 142 of the backbone 144. In addition, this frictional application of hot melt adhesive to the backbones 144 provides a strong bonding between various adhesive applications that exist in the book binding process.

What is claimed is:

1. An assembly for applying adhesive to book blocks, comprising:

a bath of adhesive, a rigid application wheel mounted at least partially in said bath of adhesive, a flexible glue wheel engaging at least a portion of said rigid application wheel, said flexible glue wheel including a rigid hub, said hub including a support flange, a flexible wheel body mounted on said rigid hub, said wheel body including a first side and a second side, and a rim, said first side and said second side each having a concave contour defined by a sharp cutout to provide flexibility to said rim, and a transport member for moving backbones of book blocks into engagement with said flexible glue wheel to apply said adhesive to each said backbone.

2. The assembly for applying adhesive to book blocks as claimed in claim 1 including means for maintaining said hot melt adhesive at a temperature of approximately 350° F.

3. The assembly for applying adhesive to book blocks claimed in claim 1 further comprising metering elements to meter adhesive on said rigid application wheel.

4. The assembly for applying adhesive to book blocks claimed in claim 1 wherein said flexible wheel body is formed of virgin silicone rubber with iron oxide.

5. The assembly for applying adhesive to book blocks claimed in claim 1 further comprising a vertical motion control coupled to said flexible glue wheel to move said flexible glue wheel vertically to control the application of adhesive on each said book block, and a braking control coupled to said flexible glue wheel to control revolution of said flexible glue wheel to control the application of adhesive on said book block.

6. The assembly for applying adhesive to book blocks claimed in claim 1 wherein said flexible wheel body further comprises a lip extending perpendicularly to said first side and said second side and secured to said support flange.

7. The assembly for applying adhesive to book blocks claimed in claim 1 wherein said flexible glue wheel is positioned above said transport member.

8. An assembly for applying hot melt adhesive to book blocks, comprising:

a bath of hot melt adhesive, said hot melt adhesive being at approximately 350° F., a rigid application wheel mounted in said bath, a flexible glue wheel engaging said rigid application wheel, said flexible glue wheel being fabricated of silicone rubber with iron oxide, and a moving member for moving book blocks into engagement with said flexible glue wheel to apply hot melt adhesive from said flexible glue wheel onto the backbone of each book block.

9. The assembly for applying adhesive to book blocks claimed in claim 8 wherein said flexible glue wheel includes a first side and a second side, said first side and said second side having a concave contour defined by a deep under cut.

10. The assembly for applying adhesive to book blocks claimed in claim 8 further comprising at least one metering device positioned relative to said bath of hot melt adhesive to meter hot melt adhesive on said rigid application wheel.

11. The assembly for applying adhesive to book blocks claimed in claim 8 further comprising a control for controlling the position of said flexible glue wheel relative to a book block.

12. The assembly for applying adhesive to book blocks claimed in claim 8 further comprising a braking control coupled to said flexible glue wheel to control flexible wheel revolution.

13. The assembly for applying adhesive to book blocks as claimed in claim 8 wherein said moving member is disposed such as to position each said book block backbone below said flexible glue wheel.

14. A flexible glue wheel for applying hot melt adhesive at a temperature of approximately 350° F. onto a backbone of a book block, comprising:

a circular body formed of silicone rubber with iron oxide, capable of withstanding temperatures exceeding 350° F. and remaining flexible, said circular body including a first side, a second side, and a rim, said first side and said second side each including a concave contour undercutting said rim to allow said rim to be flexible.

15. The flexible glue wheel for applying hot melt adhesive at a temperature of approximately 350° F. onto a back bone of a book block claimed in claim 14 further comprising a rigid hub with a flange, said circular body including a central aperture and a lip extending perpendicularly to said first side and said second side around said aperture, said lip secured to said flange.

16. In an adhesive application arrangement for book blocks and the like, the arrangement comprising an adhesive bath, an application wheel mounted to be at least partially submerged within adhesive contained in the adhesive bath, a glue wheel engaging at least a portion of the application wheel and operating in conjunction with a transport member for application of adhesive to backbones of book blocks transported into engagement with the glue wheel, the improvement wherein the glue wheel comprises:

(a) a central hub having a generally circular configuration, (b) a support flange extending about the periphery of said hub, and (c) a flexible wheel body attached to said central hub and being supported by said flange, said wheel body being defined by a periphery having a substantially U-shaped contour which includes a central curved rim section flanked on either side by contiguous sides having inner and outer surfaces, said sides having a relatively concave configuration about said inner surfaces thereof, said outer surfaces of said contiguous sides having a contour curving sharply inwardly toward said rim section.

17. The improved adhesive application arrangement according to claim 16 wherein said flexible wheel body is formed of virgin silicone rubber containing iron oxide.

18. The improved adhesive arrangement according to claim 16 wherein said flexible wheel body further comprises a lip section extending perpendicularly from one of said contiguous sides and being secured to said support flange.

19. The improved adhesive arrangement of claim 16 further comprising means for controlling the application of adhesive on said book blocks, said means including a vertical motion control coupled to said glue wheel for controlling relative vertical movement thereof, and a braking control also coupled to said wheel for controlling the revolution thereof.

* * * * *